US010531172B2

(12) United States Patent
Ono et al.

(10) Patent No.: US 10,531,172 B2
(45) Date of Patent: Jan. 7, 2020

(54) MICROPHONE HEAD AND MICROPHONE

(71) Applicant: SONY CORPORATION, Tokyo (JP)

(72) Inventors: Yui Ono, Oita (JP); Naoya Isomura, Oita (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/773,110

(22) PCT Filed: Nov. 2, 2016

(86) PCT No.: PCT/JP2016/004797

§ 371 (c)(1),
(2) Date: May 2, 2018

(87) PCT Pub. No.: WO2017/085910

PCT Pub. Date: May 26, 2017

(65) Prior Publication Data

US 2018/0324512 A1 Nov. 8, 2018

(30) Foreign Application Priority Data

Nov. 17, 2015 (JP) ..... 2015-224670

(51) Int. Cl.
*H04R 1/08* (2006.01)
*H04R 1/04* (2006.01)

(52) U.S. Cl.
CPC ..... *H04R 1/086* (2013.01); *H04R 1/04* (2013.01)

(58) Field of Classification Search
None
See application file for complete search history.

(56) References Cited

U.S. PATENT DOCUMENTS 3,515,821 A * 6/1970 Knauert ..... H04R 1/06 174/153 G
2011/0058695 A1* 3/2011 Yoshino ..... H04R 1/083 381/174
2016/0269830 A1* 9/2016 Chang ..... H04R 9/08

FOREIGN PATENT DOCUMENTS

JP 52-159223 U 12/1977
JP 56-074592 U 6/1981

OTHER PUBLICATIONS

International Search Report and Written Opinion of PCT Application No. PCT/JP2016/004797, dated Jan. 24, 2017, 06 pages of Isrwo.

* cited by examiner

*Primary Examiner* — Antim G Shah
(74) *Attorney, Agent, or Firm* — Chip Law Group

(57) ABSTRACT

A microphone head includes: a microphone capsule including a vibration plate; and a protector facing the vibration plate, the protector being made of a metallic mesh forming a plurality of openings, the openings having inclination planes at the entering side, the inclination planes receiving airflow toward the vibration plate and guiding the airflow to a predetermined inclination direction, the predetermined inclination direction being inclined from a vibration direction of the vibration plate.

4 Claims, 6 Drawing Sheets

MICROPHONE HEAD AND MICROPHONE

CROSS REFERENCE TO RELATED APPLICATIONS

This application is a U.S. National Phase of International Patent Application No. PCT/JP2016/004797 filed on Nov. 2, 2016, which claims priority benefit of Japanese Patent Application No. JP 2015-224670 filed in the Japan Patent Office on Nov. 17, 2015. Each of the above-referenced applications is hereby incorporated herein by reference in its entirety.

TECHNICAL FIELD

The present technology relates to a microphone head and a microphone for vocals.

BACKGROUND ART

Capacitor microphones, dynamic microphones, and the like are known as microphones mainly for vocals. When a user's breath or the like is blown out against a microphone of this type, a vibration plate in a microphone capsule may vibrate a lot and wind noises may be produced.

For example, Patent Literature 1 discloses a technique for preventing wind noises. Patent Literature 1 discloses a double screen structure, in which a first metal mesh screen is placed in front of a diaphragm and a second metal mesh screen is further placed in front of the first metal mesh screen. Patent Literature 1 discloses that wind noises may be reduced without affecting the acoustic feature of the microphone by appropriately selecting the distance between the diaphragm and the first metal mesh screen and the distance between the first metal mesh screen and the second metal mesh screen.

Further, there is known a technique of using not a metal mesh but a mesh made of polyamide-series fibers as a countermeasure for wind noises (see Patent Literature 2).

CITATION LIST

Patent Literature

Patent Literature 1: Japanese Patent Application Laid-open No. S59-62294 (lower left column to lower right column of p. 2, and FIG. 4)

Patent Literature 2: Japanese Patent Application Laid-open No. 2009-267721 (paragraph [0017])

DISCLOSURE OF INVENTION

Technical Problem

It is desirable to take countermeasures against acoustic noises of hand-held microphone mainly for vocals and speeches. There are known various countermeasures against acoustic noises. It is still desirable to improve various aspects such as reduction of acoustic noises, costs, and resistances.

In view of the above-mentioned circumstances, it is an object of the present technique to reduce wind noises of a microphone head and a microphone mainly for vocals with low costs.

Solution to Problem

To attain the aforementioned object, according to an embodiment of the present technique, a microphone head includes:

a microphone capsule including a vibration plate; and a protector facing the vibration plate, the protector being made of a metallic mesh having a plurality of openings, the openings having inclination planes, the inclination planes receiving airflow toward the vibration plate and guiding the airflow to a predetermined inclination direction, the predetermined inclination direction being inclined from a vibration direction of the vibration plate.

According to the microphone head of the present technique, the protector is made of a metallic mesh having a plurality of openings having inclination planes. The inclination planes receive airflow toward the vibration plate and guide the airflow to a predetermined inclination direction, the predetermined inclination direction being inclined from a vibration direction of the vibration plate. As a result, a wind pressure is applied to the surface of the vibration plate in the inclination direction, which is inclined from the vibration direction of the vibration plate. As a result, when a breath is blown out, vibration of the vibration plate may be reduced, and the wind noise level may be decreased.

Further, it is only necessary to add a single protector made of a metallic mesh. It is possible to take countermeasures against wind noises of a microphone for vocals with low costs.

The microphone head of the present technique may further include a cup-shaped cage at least accommodating the microphone capsule and the protector, the protector being placed between a top part of the cage and the vibration plate.

Further, the protector may be made of a plurality of metallic wire materials, each of the plurality of metallic wire materials having an approximately rectangular cross-section, each of the plurality of metallic wire materials being shaped waveform, the plurality of metallic wire materials being joined and staggered such that each top position of the waveform overlaps with each bottom position of the waveform.

According to this structure, the protector having uniform inclination planes is manufactured with low costs. It is possible to take countermeasures against wind noises of a microphone for vocals with low costs.

A microphone of the present technique includes:

a handle part; and a microphone head attachable to and detachable from the handle part, the microphone head including a microphone capsule including a vibration plate, and a protector facing the vibration plate, the protector being made of a metallic mesh forming a plurality of openings, the openings having inclination planes, the inclination planes receiving airflow toward the vibration plate and guiding the airflow to a predetermined inclination direction, the predetermined inclination direction being inclined from a vibration direction of the vibration plate.

Advantageous Effects of Invention

As described above, according to the present technique, it is possible to reduce wind noises of a microphone head and a microphone mainly for vocals with low costs.

MODE(S) FOR CARRYING OUT THE INVENTION

Hereinafter, an embodiment of the present technique will be described with reference to the drawings.

First Embodiment

[Structure of the Microphone 1]

Figure 1:
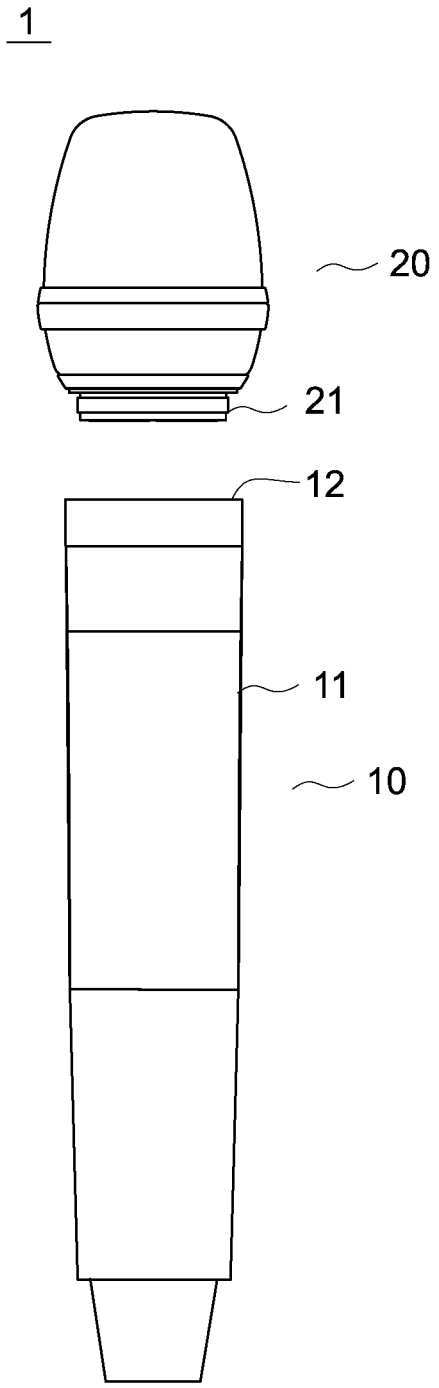
FIG. 1 A front view showing a structure of the microphone 1 of a first embodiment of the present technique.

FIG. 1 is a front view showing a structure of the microphone 1 of a first embodiment of the present technique.

As shown in FIG. 1, the microphone 1 of the present embodiment is the microphone 1 for vocals. The microphone 1 includes the handle part 10 and the microphone head 20 attachable to and detachable from the handle part 10.

The handle part 10 includes the cylindrical metallic casing 11 gripped by a user's hand. An end part of the metallic casing 11 of the handle part 10 has the head attachment hollow 12, to which the attachment 21 at an end of the microphone head 20 is to be attached. An inner surface of the head attachment hollow 12 of the handle part 10 has a screw-type female thread. Meanwhile, an outer surface of the cylindrical attachment 21 of the microphone head 20 has a screw-type male thread, which engages with the screw-type female thread of the inner surface of the head attachment hollow 12 of the handle part 10. According to this structure, by inserting the attachment 21 of the microphone head 20 into the head attachment hollow 12 at the end of the handle part 10 and rotating the microphone head 20 in the clockwise direction, the microphone head 20 is attached to the head attachment hollow 12 of the handle part 10. In addition, by rotating the microphone head 20 attached to the head attachment hollow 12 of the handle part 10 in the anticlockwise direction, the microphone head 20 can be detached from the head attachment hollow 12 of the handle part 10.

[Structure of the Microphone Head 20]

Figure 2:
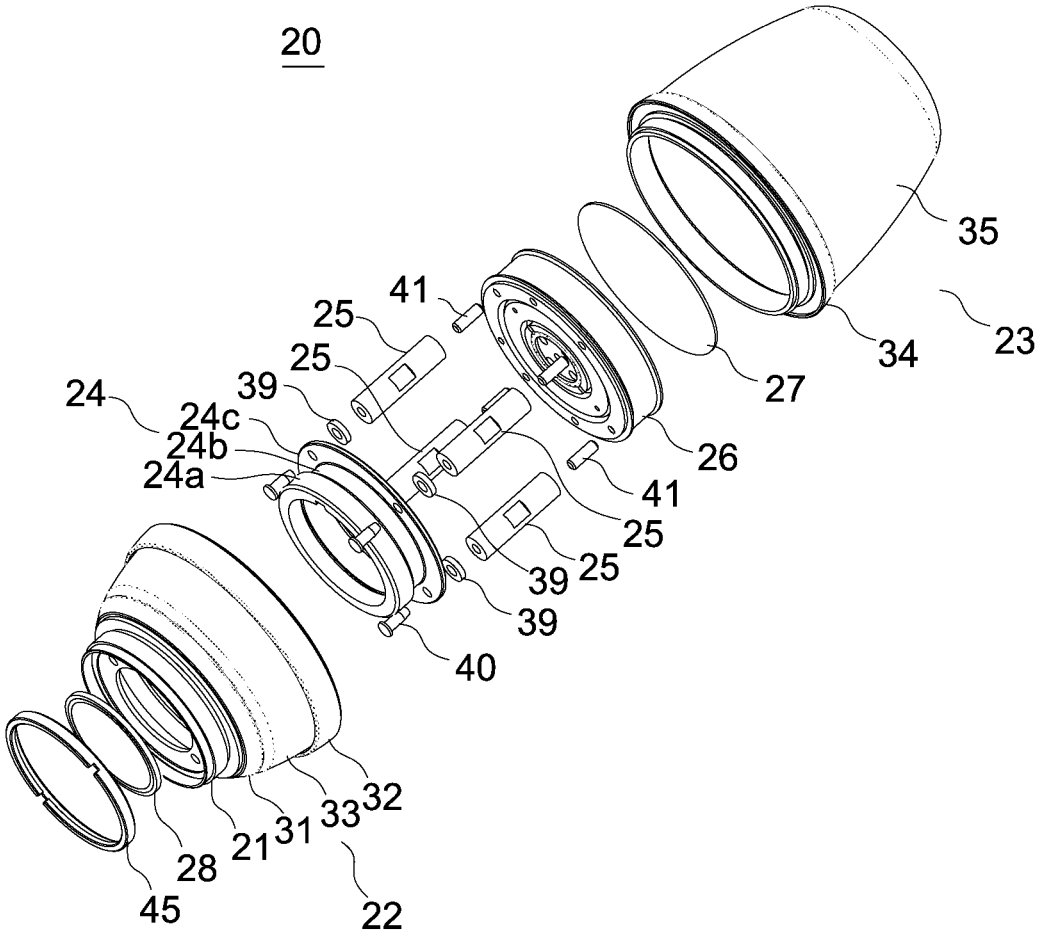
FIG. 2 An exploded perspective view showing a structure of the microphone head 20, which is exploded, of the microphone 1 of FIG. 1.
Figure 3:
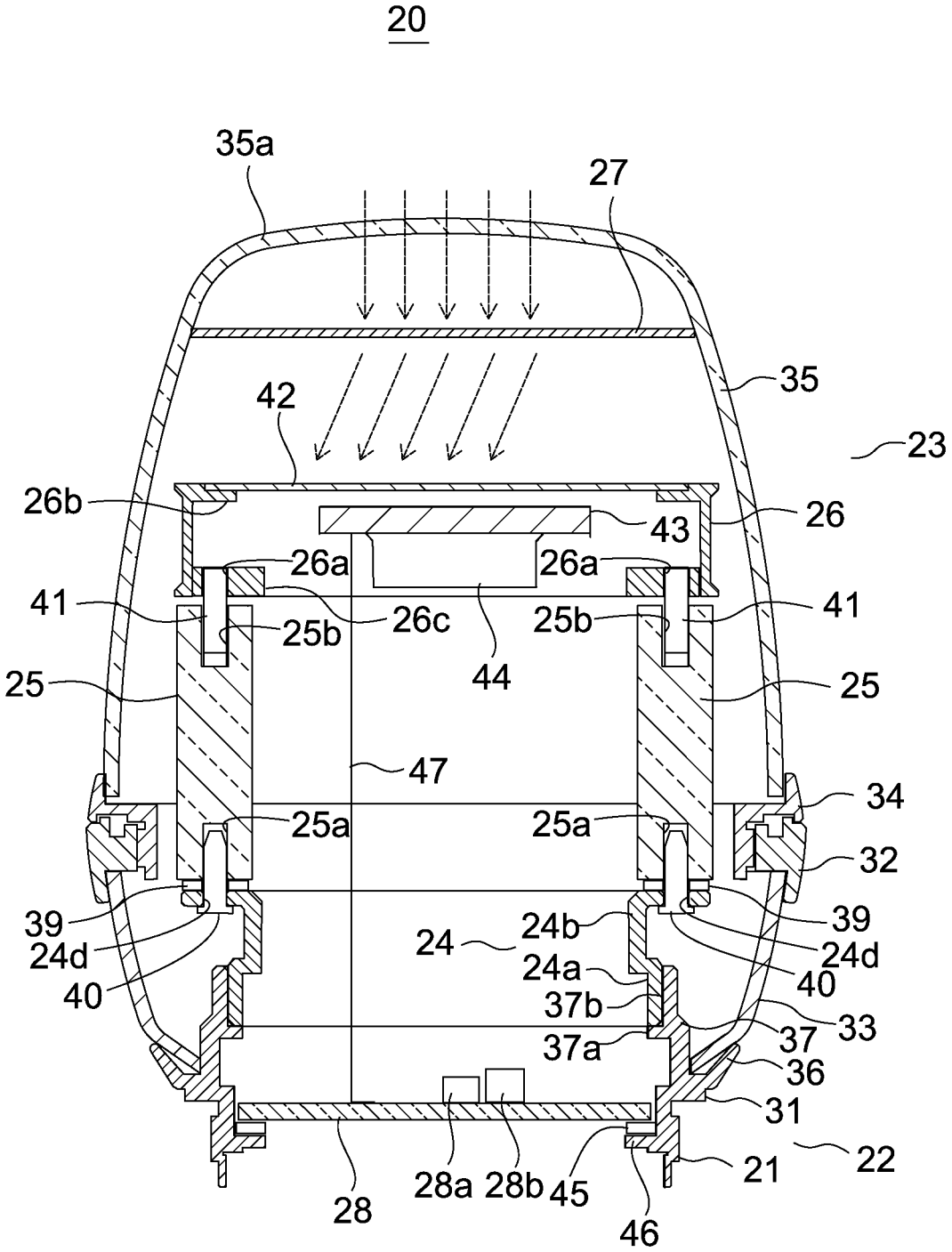
FIG. 3 A cross-sectional view showing the microphone head 20 of FIG. 2.

FIG. 2 is an exploded perspective view showing a structure of the microphone head 20, which is exploded, and FIG. 3 is a cross-sectional view showing the microphone head 20 of FIG. 2.

As shown in FIG. 2 and FIG. 3, the microphone head 20 includes the lower cage 22, the upper cage 23, the capsule base 24, the plurality of rods 25, the microphone capsule 26, the protector 27, the printed wiring board 28, and other components.

The lower cage 22 includes the metallic lower cage casing 31 including the attachment 21 to be inserted into the head attachment hollow 12 of the handle part 10, the lower cage connector 32, and the lower guard net 33 held between the lower cage casing 31 and the lower cage connector 32.

The upper cage 23 includes the upper cage connector 34 connected to the lower cage connector 32 of the lower cage 22, and the upper guard net 35 fixed onto the upper cage connector 34. The lower cage 22 and the upper cage 23 are connected together via the lower cage connector 32 and the upper cage connector 34 to form an exterior of the microphone head 20. The microphone head 20 has, in the inside, the capsule base 24, the plurality of rods 25, the microphone capsule 26, the protector 27, the printed wiring board 28, and other components.

An outer surface of the lower cage 22 has the guard net holder 36 that holds the lower guard net 33. An inner surface of the lower cage 22 has the base holder 37 that holds the capsule base 24, and the board support 46 that supports the printed wiring board 28, the ring 45 being placed between the board support 46 and the printed wiring board 28. The base receiver 37*a* and the inner surface 37*b* of the base holder 37 hold an outer surface of a lower cylindrical part of the capsule base 24, the base receiver 37*a* protruding from an inner surface of the lower cage 22, the inner surface 37*b* being of the lower cage 22, the inner surface 37*b* being above the base receiver 37*a*.

The capsule base 24 supports the microphone capsule 26 via the plurality of rods 25 and the plurality of vibration control components 39. The capsule base 24 includes the lower cylindrical part 24*a* and the upper cylindrical part 24*b*. An outer surface of the lower cylindrical part 24*a* of the capsule base 24 is held by the base holder 37 of the lower cage 22. A top end part of the upper cylindrical part 24*b* has the flange 24*c*. The flange 24*c* has the plurality of screw openings 24*d*, into which the first screw nails 40 are screwed to fix the plurality of rods 25.

The plurality of rods 25 are placed on the flange 24*c*, washers, i.e., the vibration control components 39, being placed between the rods 25 and the flange 24*c*. A lower part of the rod 25 has the lower screw hole 25*a* extending in the axis direction of the rod 25, the first screw nail 40 being screwed into the lower screw hole 25*a* to connect an end of the rod 25 to the flange 24*c* of the capsule base 24. The first screw nail 40 is screwed into the lower screw hole 25*a* of the rod 25 from the lower surface side of the flange 24*c* via the screw opening 24*d* of the flange 24*c* and via the opening of the vibration control component 39. In this manner, one end of the rod 25 is connected to the flange 24*c* of the capsule base 24 by using the first screw nail 40.

A top end part of each rod 25 has the upper screw hole 25*b* extending in the axis direction of the rod 25. The upper screw hole 25*b* has an opening that faces the microphone capsule 26 side. The second screw nail 41 is screwed into the upper screw hole 25*b* from its opening, the second screw nail 41 being protruding from the top surface of the rod 25. Further, the part of the second screw nail 41, which protrudes from the top surface of the rod 25, is screwed into the screw hole 26*a* of the microphone capsule 26.

The microphone capsule 26 has a cylindrical shape, and its uppermost part has the vibration plate holder 26*b* that holds an outer rim of the vibration plate (diaphragm) 42, which is a stationary electrode of the capacitor-type microphone. A lower part of the microphone capsule 26 has the rod receiver 26*c* having the screw holes 26*a*, each screw hole 26*a* receiving the part of the second screw nail 41 protruding from the top surface of the rod 25. In other words, the microphone capsule 26 is supported by the capsule base 24 via the plurality of rods 25 and the washers, i.e., the vibration control components 39. The stationary electrode 43 is fixed in the microphone capsule 26 via the insulative support 44.

Note that the rods 25 are made of a material having low Young's modulus and low density. Since the microphone capsule 26 is supported by the rods 25, which are made of the material having low Young's modulus and low density, sounds from the microphone 1 may have so-called "rich" and "thick" qualities. Further, since the rods 25 are supported by the flange 24*c* of the capsule base 24, the washers, i.e., the vibration control components 39, being placed between them, sounds from the microphone 1 may have less so-called "cloudy" and "unusual" tones.

The printed wiring board 28 is supported by the board support 46 protruding from an inner surface of the lower cage 22, the ring 45 being placed between the printed wiring board 28 and the board support 46. The printed wiring board 28 is electrically connected to the stationary electrode 43 in the microphone capsule 26 via the wiring 47. The integrated circuits 28*a* and 28*b* such as a circuit that detects a voltage between the vibration plate (diaphragm) 42, i.e., a movable electrode, and the stationary electrode 43, and an impedance conversion circuit, and other components are mounted on the printed wiring board 28.

The protector 27 is placed in the upper guard net 35 of the upper cage 23. The protector 27 is a component made of a metallic mesh such as a stainless steel mesh, for example, and having a number of openings 27*c* penetrating in the thickness direction. The protector 27 is placed between the top part 35*a* of the cup-shaped upper guard net 35 and the vibration plate 42 of the microphone capsule 26, and faces a vibration plane of the vibration plate 42. Note that the protector 27 is adhered to, for example, an inner surface of the upper guard net 35 by means of welding or the like, for example.

[Structure of the Protector 27]

Figure 4:
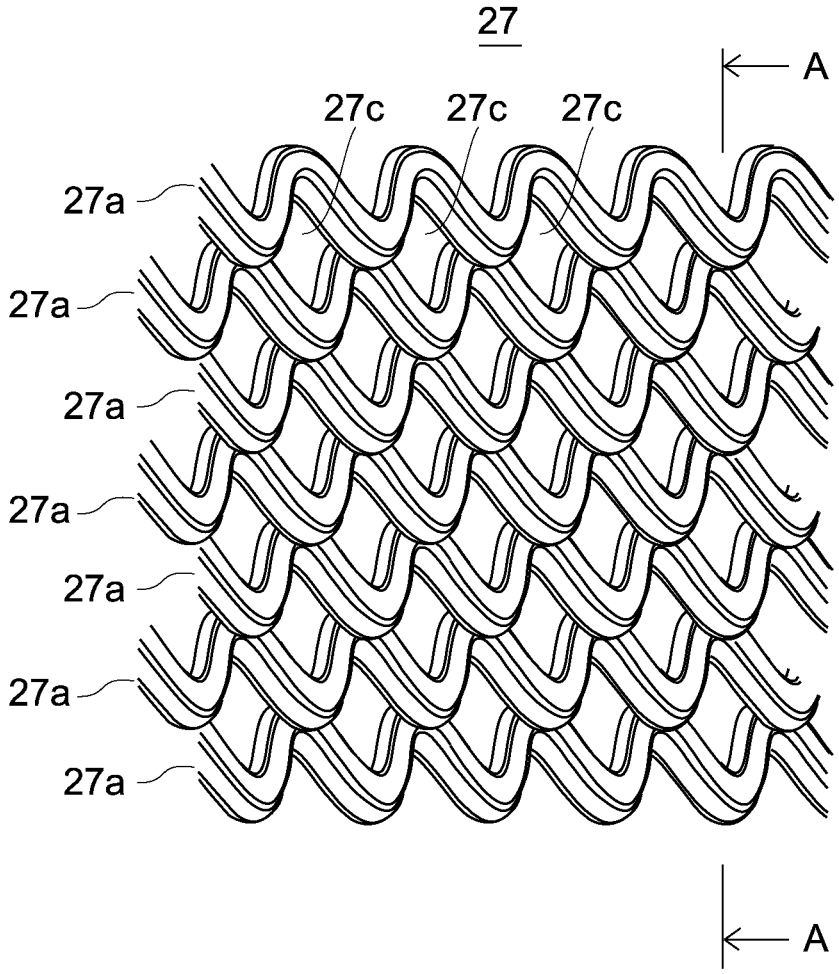
FIG. 4 A partial enlarged perspective view showing the protector 27 of the microphone head 20 of FIG. 3.
Figure 5:
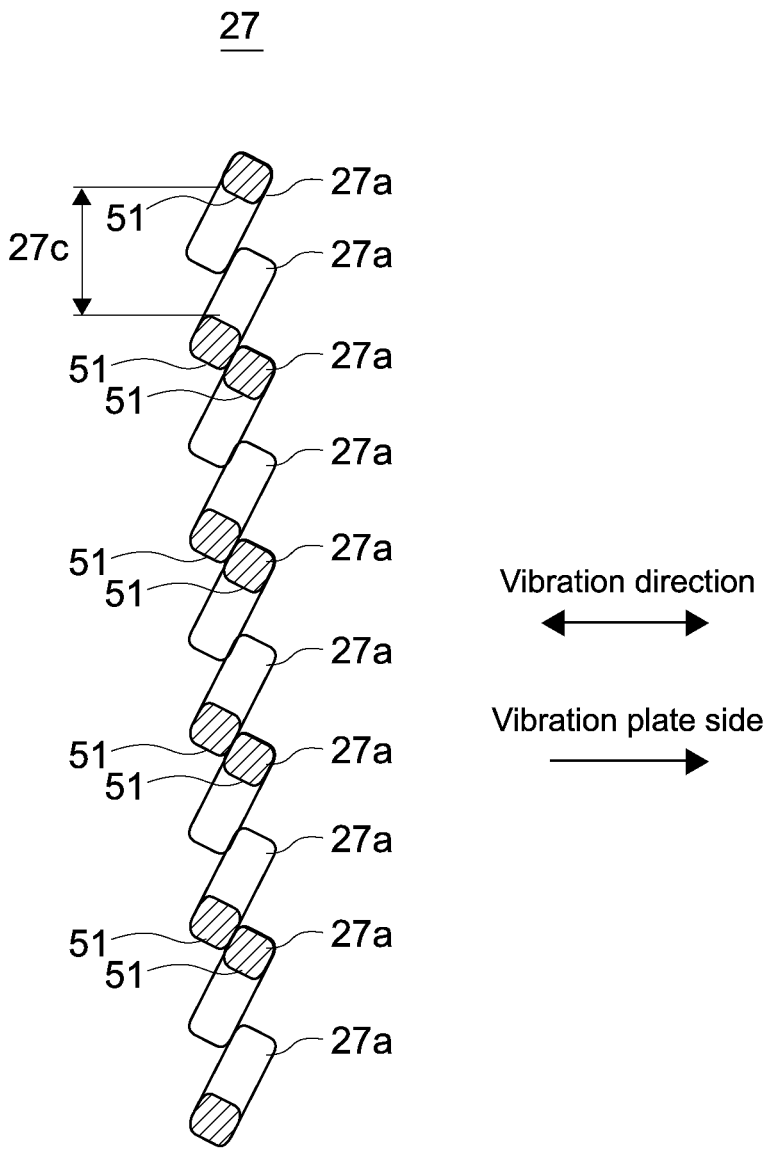
FIG. 5 A partial cross-sectional view showing the protector 27 taken along A-A of FIG. 4.

FIG. 4 is a partial enlarged perspective view showing the protector 27, and FIG. 5 is a partial cross-sectional view showing the protector 27 (cross-sectional view taken along A-A of FIG. 4).

As shown in FIG. 4 and FIG. 5, the protector 27 includes a metallic mesh and the like, the metallic mesh being made of the plurality of metallic wire materials 27*a*, for example, each of the plurality of metallic wire materials 27*a* having an approximately rectangular cross-section, each of the plurality of metallic wire materials 27*a* being shaped waveform, the plurality of metallic wire materials 27*a* being joined and staggered such that each top position of the waveform overlaps with each bottom position of the waveform.

As shown in the cross-section of the protector 27 of FIG. 5, the top end (of FIG. 5) of each opening 27*c* of the protector 27 has the inclination plane 51, the inclination plane 51 being inclined from the vibration direction of the vibration plate 42. In other words, since the metallic wire materials 27*a* are inclined and joined in combination such that each top position of the waveform overlaps with each bottom position of the waveform, as described above, a surface of each metallic wire material 27*a* has the plane 51, which is inclined from the vibration direction of the vibration plate 42.

Some inclination planes 51, which are around the respective openings 27*c* of the protector 27 having the aforementioned structure, guide part of airflow, which has entered into the vibration plate 42 from the outside, in a predetermined inclination direction, the predetermined inclination direction being inclined from the vibration direction of the vibration plate 42. When guiding part of airflow, which has entered into the vibration plate 42 from the outside, in a predetermined inclination direction, the predetermined inclination direction being inclined from the vibration direction of the vibration plate 42, a wind pressure is applied to the vibration plate 42 in the inclination direction, which is inclined from the vibration direction of the vibration plate 42. As a result, when a user's breath is blown out against the microphone head 20, vibration of the vibration plate 42 may be reduced, and the wind noise level may be decreased.

Next, with reference to FIG. 6, the inclination planes 51 and 52 around the opening 27*c* of the protector 27 will be described, the inclination planes 51 and 52 guiding at least part of airflow, which has entered into the vibration plate 42 from the outside, in a predetermined inclination direction, the predetermined inclination direction being inclined from the vibration direction of the vibration plate 42.

Figure 6:
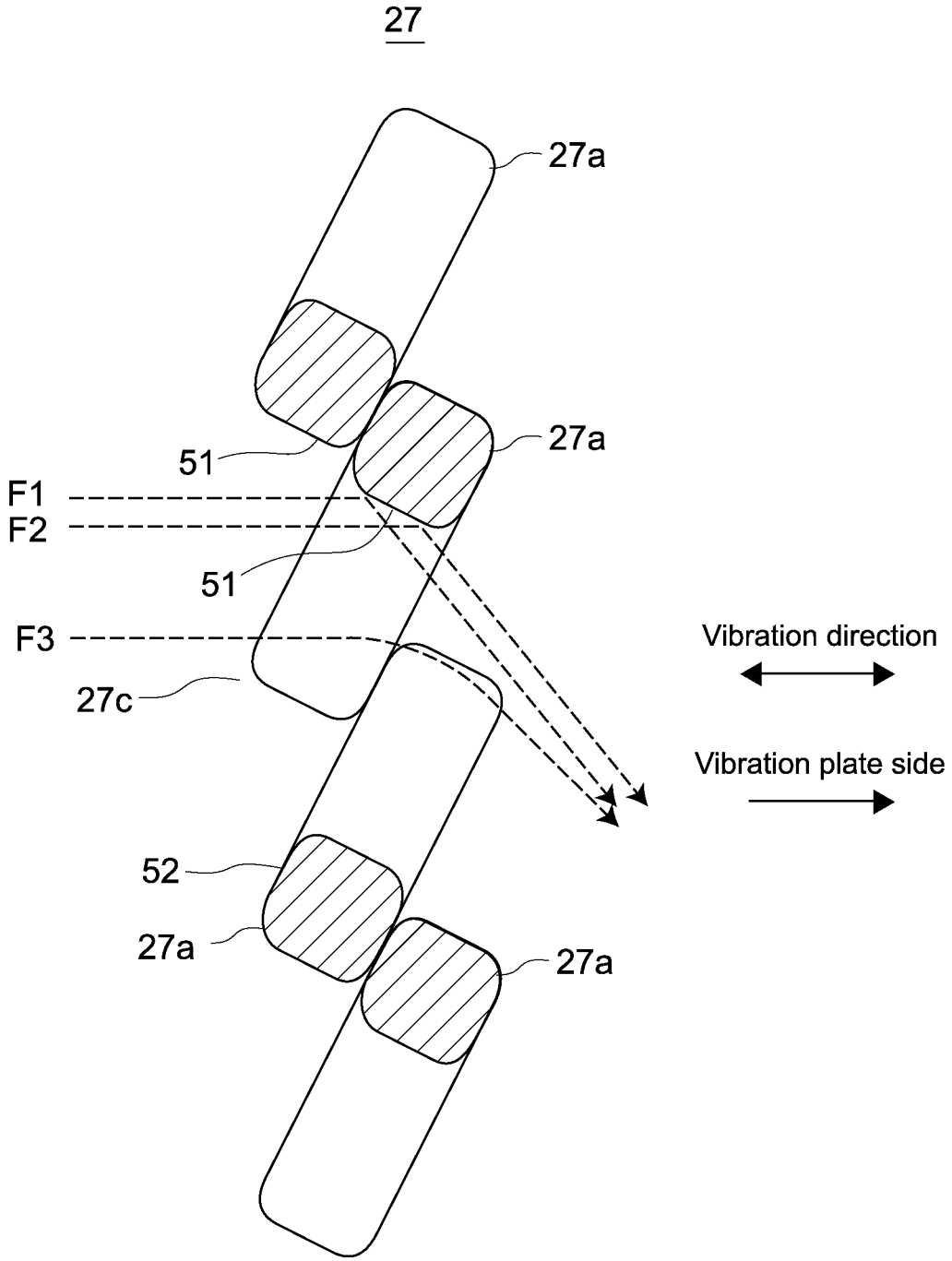
FIG. 6 An enlarged cross-sectional view showing the protector 27 of FIG. 4.

In FIG. 6, the inclination planes 51, which significantly guide airflow in the inclination direction inclined from the vibration direction of the vibration plate 42, are mainly two inclination planes 51 shown in the upside of FIG. 6. The inclination planes 51 are at the top end side (of FIG. 6) of the opening 27*c* of the protector 27. In this case, the inclination planes 51 guide part of airflows F1 and F2, which have entered into the opening 27*c* of the protector 27, in the downward inclination direction of FIG. 6. The airflow F3, which has entered into the opening 27*c* from a position where the airflow F3 clashes against no inclination plane 51, is mixed with the airflows F1 and F2, which have been guided by the inclination planes 51 in the downward inclination of FIG. 6, and is also guided in the downward inclination direction of FIG. 6. As a result, the airflow direction as a whole in a zone at the downstream side of the protector 27 is the downward inclination direction of FIG. 6, and a wind pressure is applied to the surface of the vibration plate 42 in the inclination direction (of FIG. 6) from the vibration direction of the vibration plate 42. As a result, when a breath is blown out against the microphone head 20, vibration of the vibration plate 42 may be reduced, and the wind noise level may be decreased.

Meanwhile, the inclination direction of the inclination plane 52 shown in the downside of FIG. 6 is opposite to the inclination direction of the inclination plane 51 shown in the upside of FIG. 6. However, since the inclination angle of the inclination plane 52 shown in the downside of FIG. 6 from the vibration direction of the vibration plate 42 is almost the right angle, the inclination plane 52 guides almost no airflow. As a result, airflow guided by the inclination plane 52 shown in the downside of FIG. 6 gives no unnecessary turbulence to airflow guided by the two inclination planes 51 shown in the upside of FIG. 6.

Note that the upside and downside of FIG. 6 do not mean specific directions of the microphone 1. In other words, what is important in the present technique is that the inclination plane 51, which significantly guides airflow in the inclination direction inclined from the vibration direction of the vibration plate 42, has a predetermined inclination direction, the predetermined inclination direction being inclined from the vibration direction of the vibration plate 42.

The microphone 1 having the protector 27, the inclination angle of inclination plane 51 from the vibration direction of the vibration plate 42 being 23 degrees and the opening percentage of the protector 27 being 43%, was prepared. Airflow having a predetermined speed was blown out against the microphone 1. Pop noises in the sound output from the microphone 1 were measured. The pop noises from the microphone 1 were less than pop noises from a microphone without the protector 27 by 3 dB (about 30%).

Note that, ideally, the inclination angle of the inclination plane 51 from the vibration direction of the vibration plate 42 is within a range of about, for example, plus and minus 5 degrees from 23 degrees, which is selected for the aforementioned test.

According to a typical countermeasure against wind noises, there is known a method of placing urethane resin or an acoustic resistance material in a cage. However, such material functions as a low-pass filter for sounds and affects the sound quality, which is a drawback. According to the present embodiment, the protector 27 made of a metallic mesh may reduce wind noises without affecting acoustic features.

The present technique is not limited to an embodiment of an image pickup device itself, but may be variously modified and used within the technical scope of the present technique of the scope of claims.

Modification Example 1

The present technique may be applicable to not only the capacitor-type microphone of the aforementioned embodiment, but microphones of other types, e.g., a dynamic-type microphone, for example.

In the aforementioned embodiment, a metallic mesh is used as the protector. Not limited to the metallic mesh, alternatively, the present technique may employ a protector made of another material and having an opening percentage similar to the opening percentage of the metallic mesh.

The present technique may employ the following structure.

(1) A microphone head, including:

a microphone capsule including a vibration plate; and a protector facing the vibration plate, the protector being made of a metallic mesh having a plurality of openings, the openings having inclination planes, the inclination planes receiving airflow toward the vibration plate and guiding the airflow to a predetermined inclination direction, the predetermined inclination direction being inclined from a vibration direction of the vibration plate.

(2) The microphone head according to (1), further including:

a cup-shaped cage at least accommodating the microphone capsule and the protector, the protector being placed between a top part of the cage and the vibration plate.

(3) The microphone head according to (1) or (2), in which the protector is made of a plurality of metallic wire materials, each of the plurality of metallic wire materials having an approximately rectangular cross-section, each of the plurality of metallic wire materials being shaped waveform, the plurality of metallic wire materials being joined and staggered such that each top position of the waveform overlaps with each bottom position of the waveform.

REFERENCE SIGNS LIST

1 microphone
10 handle part
20 microphone head
22 lower cage
23 upper cage
24 capsule base
26 microphone capsule
27 protector
27*a* metallic wire material
27*c* opening
42 vibration plate
51 inclination plane

The invention claimed is:

1. A microphone head, comprising:

a microphone capsule including a vibration plate; and a protector that faces the vibration plate, wherein the protector is made of a metallic mesh having a plurality of openings, each opening of the plurality of openings has a first inclination plane of a plurality of inclination planes, the first inclination plane of the plurality of inclination planes receives airflow toward the vibration plate and guides the airflow in a specific inclination direction, and the specific inclination direction is inclined from a vibration direction of the vibration plate, wherein the protector is made of a plurality of metallic wire materials, wherein each metallic wire material of the plurality of metallic wire materials has a rectangular cross-section, each metallic wire material of the plurality of metallic wire materials is shaped in a waveform, and a first metallic wire material of the plurality of metallic wire materials and a second metallic wire material of the plurality of metallic wire materials are joined and staggered such that a top position of the waveform of the first metallic wire material overlaps with a bottom position of the waveform of the second metallic wire material.

2. The microphone head according to claim 1, further comprising:

a cup-shaped cage that accommodates at least the microphone capsule and the protector, wherein the protector is between a top part of the cup-shaped cage and the vibration plate.

3. A microphone, comprising:

a handle part; and a microphone head attachable to and detachable from the handle part, wherein the microphone head includes a microphone capsule including a vibration plate; and a protector that faces the vibration plate, wherein the protector is made of a metallic mesh having a plurality of openings, each opening of the plurality of openings has an inclination plane of a plurality of inclination planes, the inclination plane of the plurality of inclination planes receives airflow toward the vibration plate and guides the airflow in a specific inclination direction, and the specific inclination direction is inclined from a vibration direction of the vibration plate, wherein the protector is made of a plurality of metallic wire materials, wherein each metallic wire material of the plurality of metallic wire materials has a rectangular cross-section, each metallic wire material of the plurality of metallic wire materials is shaped in a waveform, and a first metallic wire material of the plurality of metallic wire materials and a second metallic wire material of the plurality of metallic wire materials are joined and staggered such that a top position of the waveform of the first metallic wire material overlaps with a bottom position of the waveform of the second metallic wire material.

4. The microphone head according to claim 1, wherein the plurality of inclination planes around the plurality of openings includes a second inclination plane orthogonal to the first inclination plane, and the second inclination plane is substantially orthogonal to the vibration direction.

* * * * *